US010164338B2

(12) United States Patent
Ganchrow et al.

(10) Patent No.: US 10,164,338 B2
(45) Date of Patent: Dec. 25, 2018

(54) MULTIPLE ANTENNAS CONFIGURED WITH RESPECT TO AN APERTURE

(71) Applicant: QUALCOMM Incorporated, San Diego, CA (US)

(72) Inventors: Elimelech Ganchrow, Zichron Yaakov (IL); Alon Yehezkely, Haifa (IL); Moshe Marat Donskoy, Haifa (IL)

(73) Assignee: QUALCOMM Incorporated, San Diego, CA (US)

( * ) Notice: Subject to any disclaimer, the term of this patent is extended or adjusted under 35 U.S.C. 154(b) by 158 days.

(21) Appl. No.: 15/192,298

(22) Filed: Jun. 24, 2016

(65) Prior Publication Data

US 2017/0062937 A1 Mar. 2, 2017

Related U.S. Application Data

(60) Provisional application No. 62/209,801, filed on Aug. 25, 2015, provisional application No. 62/279,482, filed on Jan. 15, 2016.

(51) Int. Cl.

| | |
|---|---|
| ***H01Q 1/24*** | (2006.01) |
| ***H01Q 9/04*** | (2006.01) |
| ***H01Q 1/48*** | (2006.01) |
| ***H01Q 1/38*** | (2006.01) |
| ***H01Q 1/36*** | (2006.01) |
| ***H01Q 9/42*** | (2006.01) |
| ***H01Q 21/08*** | (2006.01) |
| ***H01Q 21/28*** | (2006.01) |
| ***H01Q 25/00*** | (2006.01) |

(52) U.S. Cl.

CPC ..... *H01Q 9/0421* (2013.01); *H01Q 1/243* (2013.01); *H01Q 1/36* (2013.01); *H01Q 1/38* (2013.01); *H01Q 1/48* (2013.01); *H01Q 9/42* (2013.01); *H01Q 21/08* (2013.01); *H01Q 21/28* (2013.01); *H01Q 25/00* (2013.01)

(58) Field of Classification Search

CPC ..... H01Q 1/48; H01Q 1/243; H01Q 1/38; H01Q 1/36; H01Q 9/41; H01Q 21/08; H01Q 21/28; H01Q 25/00

See application file for complete search history.

(56) References Cited

U.S. PATENT DOCUMENTS

| | | | | |
|---|---|---|---|---|
| 5,497,164 | A * | 3/1996 | Croq | H01Q 9/0414 343/700 MS |
| 2006/0208949 | A1 | 9/2006 | Hirabayashi | |
| 2010/0245191 | A1 | 9/2010 | Castaneda | |

(Continued)

FOREIGN PATENT DOCUMENTS

| | | | |
|---|---|---|---|
| WO | 9837592 | A1 | 8/1998 |
| WO | 2013000519 | A2 | 1/2013 |

OTHER PUBLICATIONS

International Search Report and Written Opinion—PCT/US2016/047354—ISA/EPO—Nov. 29, 2016—11 pgs.

*Primary Examiner* — Dieu H Duong
(74) *Attorney, Agent, or Firm* — Hunter Clark PLLC

(57) ABSTRACT

A device includes a first antenna and a second antenna. The first antenna may be configured to transmit or receive through an aperture provided by the device. The second antenna may include an array of a plurality of antenna elements configured to transmit or receive through the aperture. The plurality of antenna elements may overlap at least a portion of the first antenna.

18 Claims, 11 Drawing Sheets

(56) References Cited

U.S. PATENT DOCUMENTS

| | | | | |
|---|---|---|---|---|
| 2011/0279338 | A1 | 11/2011 | Myszne et al. | |
| 2012/0293392 | A1* | 11/2012 | Barratt | H01Q 1/243 343/860 |
| 2013/0057440 | A1 | 3/2013 | Brown et al. | |
| 2014/0139380 | A1 | 5/2014 | Ouyang et al. | |
| 2014/0361945 | A1* | 12/2014 | Misra | H01Q 1/42 343/789 |
| 2015/0035714 | A1 | 2/2015 | Zhou | |
| 2015/0116169 | A1 | 4/2015 | Ying | |

* cited by examiner

MULTIPLE ANTENNAS CONFIGURED WITH RESPECT TO AN APERTURE

CROSS REFERENCE TO RELATED APPLICATIONS

This application claims priority to U.S. Provisional Pat. App. Ser. No. 62/209,801, entitled "ANTENNA APERTURES INCLUDING A PLURALITY OF ANTENNAS," filed Aug. 25, 2015, and to U.S. Provisional Pat. App. Ser. No. 62/279,482, entitled "ANTENNA APERTURES INCLUDING A PLURALITY OF ANTENNAS," filed Jan. 15, 2016, both assigned to the assignee of the present disclosure, the contents of which are hereby incorporated by reference herein in their entirety.

FIELD

The disclosure relates generally to wireless communication devices. More specifically, the disclosure relates to wireless communication device antennas.

BACKGROUND

Electronic devices (e.g., cellular telephones, wireless modems, computers, digital music players, Global Positioning System units, Personal Digital Assistants, gaming devices, etc.) have become a part of everyday life. Small computing devices are now placed in everything from automobiles to housing locks. The complexity of electronic devices has increased dramatically in the last few years. For example, many electronic devices have one or more processors that help control the device, as well as a number of electronic circuits to support the processor and other parts of the device.

Electronic devices, such as portable communication devices, continue to diminish in size. Portable communication devices use some type of antenna for transmitting and receiving communication signals. Some electronic devices now utilize multiple antennas capable of transmitting and receiving radio signals over a variety of wireless networks and associated bandwidths. However, the operation of multiple antennas often requires that the antennas be isolated some distance away from one another to avoid interference or antenna coupling. Furthermore, electronic devices frequently include enclosures comprised of materials that may impede transmission of wireless signals. Accordingly, apertures or openings in the signal impeding enclosure material may be provided through which an antenna may transmit and receive signals. As the quantity of antennas increases, a respective quantity of apertures may become undesirable.

SUMMARY

Exemplary embodiments, as described herein, may include a plurality of antennas for use with and/or positioned with respect to a common aperture. According to one exemplary embodiment, a device may include a first antenna and a second antenna. The first antenna may be configured to transmit or receive through an aperture provided by the device. The second antenna may include an array of a plurality of antenna elements configured to transmit or receive through the aperture. The plurality of antenna elements may overlap at least a portion of the first antenna.

According to another exemplary embodiment, the present disclosure includes methods of transmitting or receiving. Various embodiments of such a method may include receiving or transmitting a first wireless signal through an aperture of a device using a first antenna in the device. The method may further include receiving or transmitting a second wireless signal through the aperture using a second antenna including an array of a plurality of antenna elements which overlap at least a portion of the first antenna.

Other aspects, as well as features and advantages of various aspects, will become apparent to those of skill in the art though consideration of the ensuing description, the accompanying drawings and the appended claims.

DETAILED DESCRIPTION

The detailed description set forth below in connection with the appended drawings is intended as a description of exemplary embodiments and is not intended to represent the only embodiments which can be practiced. The term "exemplary" used throughout this disclosure means "serving as an example, instance, or illustration," and not necessarily as preferred or advantageous over other exemplary embodiments. The detailed description includes specific details for the purpose of providing a thorough understanding of the exemplary embodiments. The exemplary embodiments of the disclosure may be practiced without these specific details. In some instances, known structures and devices are shown in block diagram form in order to avoid obscuring the novelty of embodiments presented herein.

Figure 1:
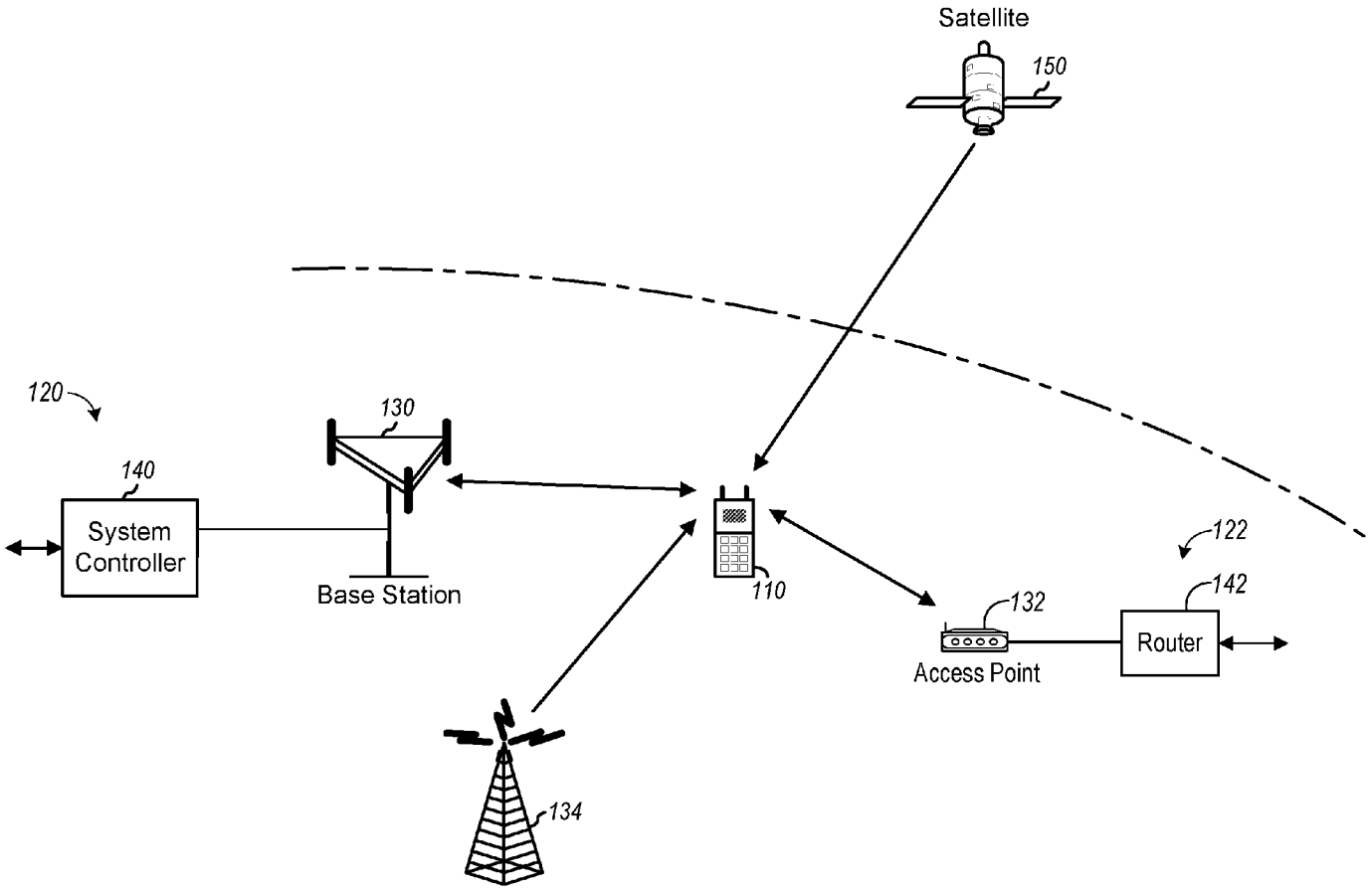
FIG. 1 illustrates a wireless device capable of communicating with different wireless communication systems, in accordance with an exemplary embodiment.

FIG. 1 illustrates a wireless device 110 capable of communicating with different wireless communication systems 120 and 122, in accordance with an exemplary embodiment. Wireless system 120 may be a cellular system such as a Long Term Evolution (LTE) system, a Code Division Multiple Access (CDMA) system, a Global System for Mobile Communications (GSM) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA. Wireless system 122 may be a wireless local area network (WLAN) system, which may implement IEEE 802.11, HiperLAN, etc. For simplicity, FIG. 1 shows wireless system 120 including one base station 130 and one system controller 140, and wireless system 122 including one access point 132 and one router 142. In general, each wireless system may include any number of stations and any set of network entities.

Wireless device 110 may also be referred to as a user equipment (UE), a mobile station, a terminal, an access terminal, a subscriber unit, a station, etc. Wireless device 110 may be a cellular phone, a smartphone, a tablet, a wireless modem, a personal digital assistant (PDA), a hand-held device, a laptop computer, a smartbook, a netbook, a cordless phone, a wireless local loop (WLL) station, a Bluetooth device, etc. Wireless device 110 may communicate with wireless system 120 and/or 122. Wireless device 110 may also receive signals from broadcast stations (e.g., a broadcast station 134), and/or signals from satellites (e.g., a satellite 150), for example in one or more global navigation satellite systems (GNSS), etc. Wireless device 110 may support one or more radio technologies for wireless communication such as LTE, WCDMA, CDMA 1×, EVDO, TD-SCDMA, GSM, IEEE 802.11, etc.

Wireless device 110 may support operation at a very high frequency, e.g., within millimeter (mm)-wave frequencies from approximately 20 to 300 gigahertz (GHz) (e.g., 28 GHz or 60 GHz). For example, wireless device 110 may operate at 60 GHz for IEEE 802.11ad. Wireless device 110 may include an antenna system to support operation at mm-wave frequency. The antenna system may include a number of antenna elements, with each antenna element being used to transmit and/or receive signals. The terms "antenna" and "antenna element" may be used interchangeably. Each antenna element may be implemented with a patch antenna, a dipole antenna, or an antenna of some other type. A suitable antenna type may be selected for use based on the operating frequency of the wireless device, the desired performance, etc. In an exemplary embodiment, an antenna system may include a number of patch antennas supporting operation at mm-wave frequency.

Figure 2:
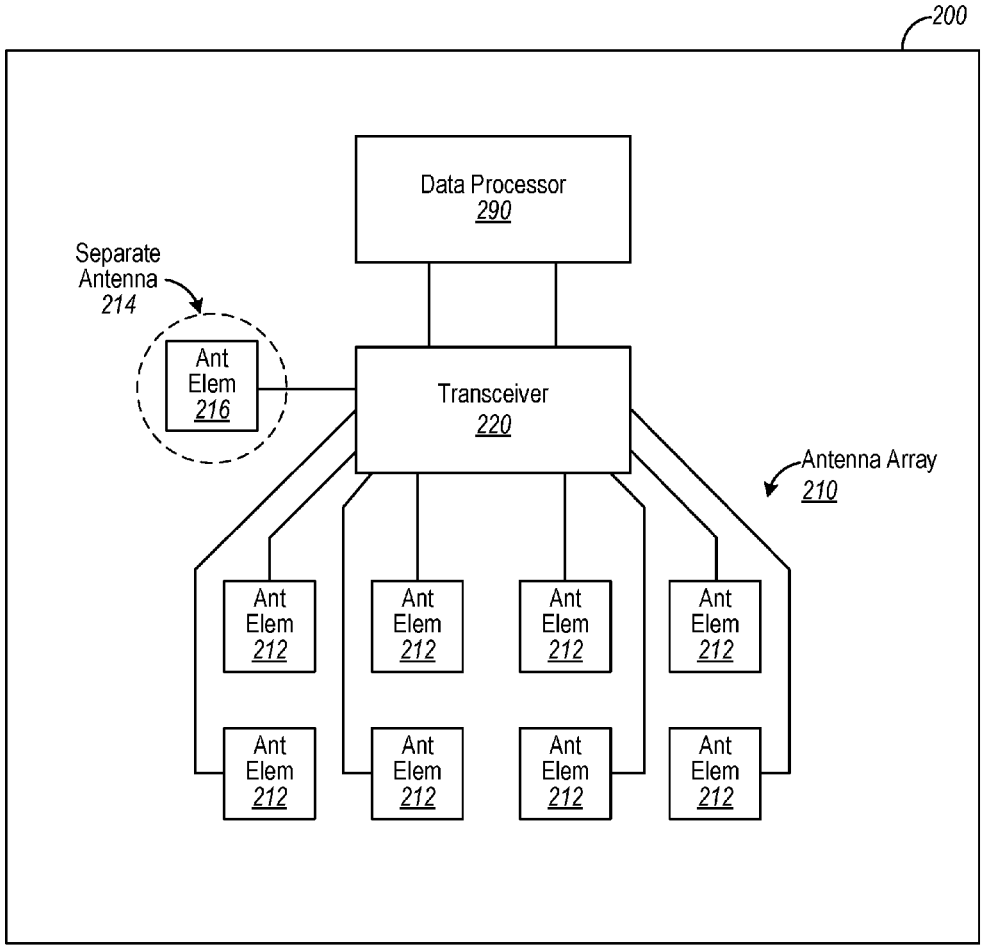
FIG. 2 illustrates a block diagram of a wireless device with an antenna array and a separate antenna, in accordance with an exemplary embodiment.

FIG. 2 illustrates a block diagram of a wireless device 200 with an antenna array 210 and a separate antenna 214, in accordance with an exemplary embodiment. Wireless device 200 may be one exemplary embodiment of wireless device 110 in FIG. 1. Wireless device 200 further includes a transceiver 220 and a data processor 290. Other elements, for example radio frequency (RF) front end components, may be included in the device 200, but are not illustrated in FIG. 2. The view illustrated in FIG. may represent a top view of an exemplary layout of antenna array 210 and separate antenna 214. Antenna array 210 includes a number of antenna elements 212, which may be arranged in an M×N grid as shown in FIG. 2, where M and N may each be any integer value. Separate antenna 214 is implemented with one antenna element 216 that is separate from antenna elements 212 of antenna array 210. For example, the element 216 may be formed of different materials and/or may not share any components or supporting structure with any of the elements 212. Antenna element 216 of separate antenna 214 may be located separate from antenna elements 212 of antenna array 210. For example, the element 216 may be located such that it does not overlap any of the elements 212 when viewed from a particular direction, e.g., a direction in which one of the elements 212 and/or 216 is configured to transmit or receive from. In certain embodiments described herein, antenna elements 212 of antenna array 210 are collocated with antenna element 216 of separate antenna 214 as will be described in greater detail below. The separate antenna 214 may be configured to support a different wireless system or a different RAT than the elements 212.

Antenna elements 212 and 216 may each be a patch antenna as shown in FIG. 2 or an antenna of some other type. A patch antenna may be implemented with a conductive patch or structure of any suitable size, which may be selected based on a target operating frequency (e.g., 60 GHz) of wireless device 200. A patch antenna may also be implemented with a conductive patch or structure of any suitable shape, which may be selected to obtain a desired antenna beam pattern.

In an exemplary embodiment, antenna elements 212 and 216 may have dissimilar size and shape. In this exemplary embodiment, separate antenna 214 may be configured as an inverted F antenna (IFA). In another exemplary embodiment, separate antenna 214 may be configured as a planar inverted F antenna (PIFA). In yet another exemplary embodiment, separate antenna 214 may be configured as a meandered inverted F antenna (MIFA). Antenna elements 212 of antenna array 210 may be coupled to or formed on planar aspects of the separate antenna 214.

In some embodiments, transceiver 220 is coupled to all antenna elements 212 of antenna array 210 and to antenna element 216 of separate antenna 214 as shown in FIG. 2. Transceiver 220 includes transmit circuits to generate an output RF signal for transmission via antenna elements 212 or 216. Transceiver 220 also includes receive circuits to condition and process an input RF signal obtained from antenna elements 212 or 216. In general, wireless device 200 may include one or more antenna arrays and one or more separate antennas. Each separate antenna may be implemented with an antenna element that is separate from the antenna elements of the antenna array(s). Transceiver 220 may be coupled to all antenna elements of the antenna array(s) and all antenna elements of the separate antenna(s). Transceiver 220 may generate one or more output RF signals for the antenna elements and process one or more input RF signals from the antenna elements. In other embodiments, a plurality of transceivers may be implemented in the device 200. Respective transceivers may be coupled to and/or configured to operate the antenna 216 and the elements of the array 210. In some embodiments, certain of the elements of the array 210 are coupled to a first transceiver and other elements of the array 210 are coupled to a second transceiver.

Figure 3A:
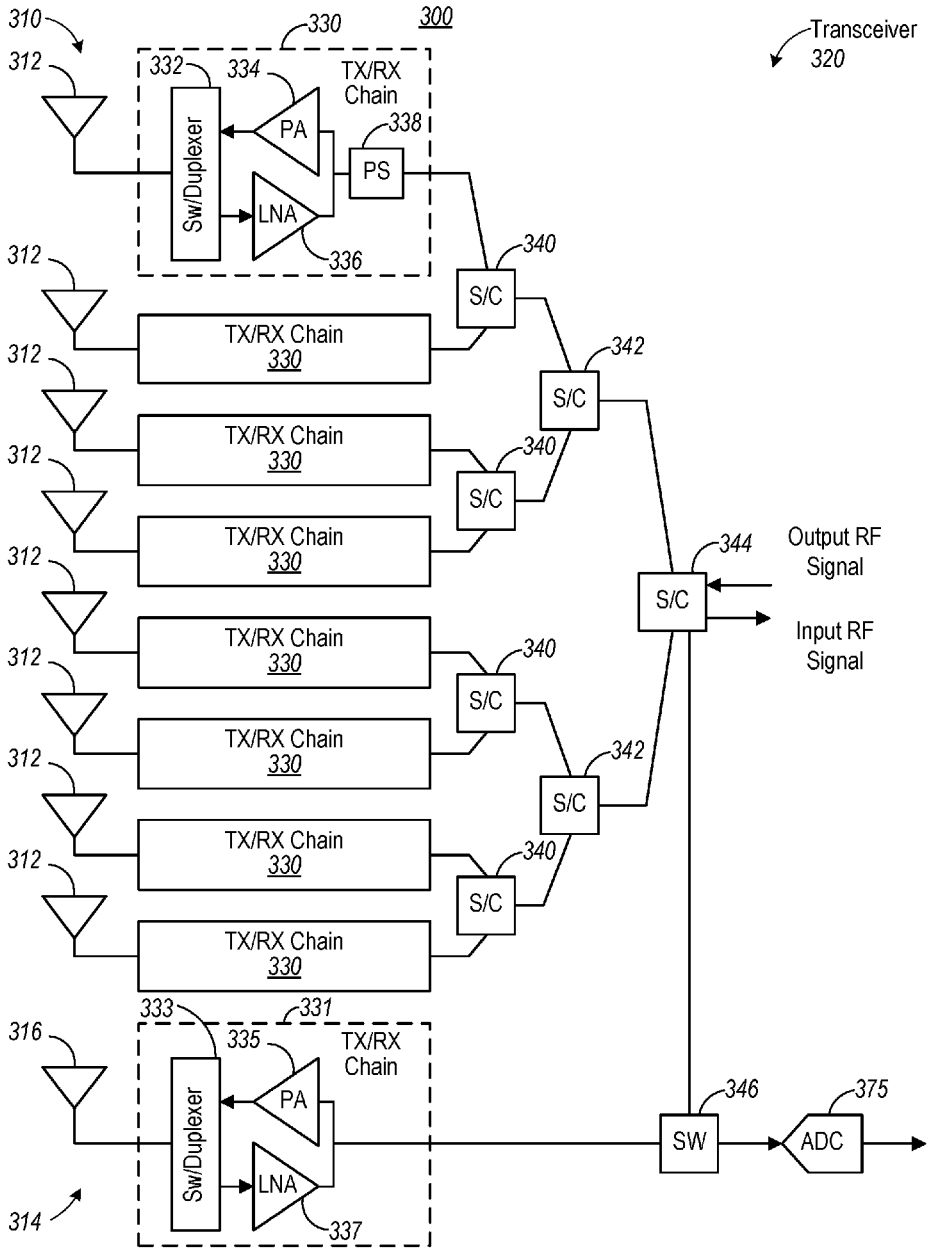
FIGS. 3A and 3B illustrate a schematic diagram of a wireless device including a transceiver, in accordance with an exemplary embodiment.
Figure 3B:
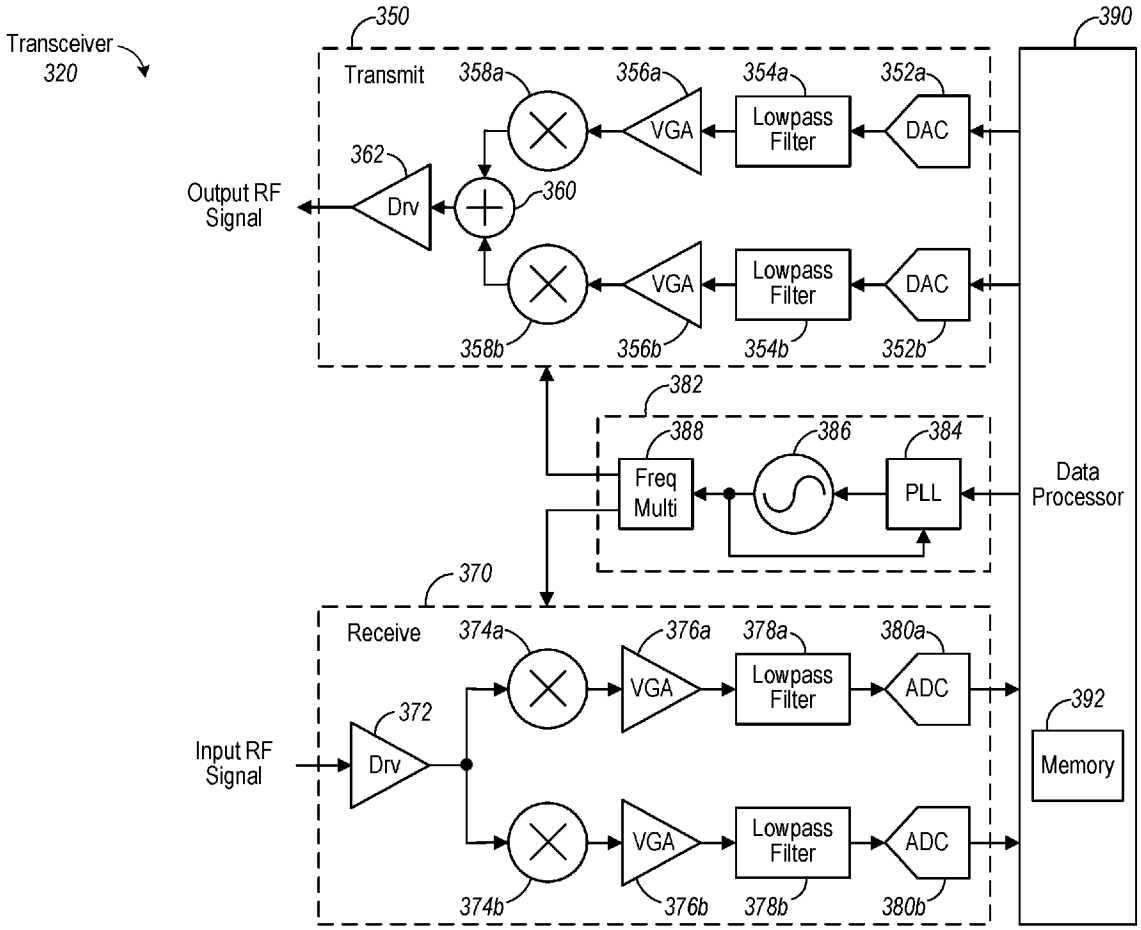

FIGS. 3A and 3B illustrate a schematic diagram of a wireless device 300 including a transceiver 320, in accordance with an exemplary embodiment. Wireless device 300 may be one exemplary embodiment of wireless device 110 in FIG. 1, and the transceiver 320 may be one exemplary embodiment of the transceiver 220 in FIG. 2 and/or may be implemented in the wireless device 110.

Transceiver 320 includes a front-end 322 and a back-end 324. In the exemplary embodiment shown in FIG. 3A, the transceiver 322 includes a TX/RX chain 330 for each antenna element 312 of antenna array 310, a TX/RX chain 331 for antenna element 316 of separate antenna 314, splitters/combiners 340, 342 and 344, and a switch 346. In some embodiments, elements illustrated in FIG. 3A may be implemented outside of the transceiver. For example, the PA 334 and/or 335 and/or one or more of the switches or duplexers 332 and/or 33 may be implemented in a chip or module which is separate from the transceiver 320, for example in a module implemented in a front end of the device 300 and/or coupled to the transceiver 320 on a circuit board. The elements 312 may be used to implement the elements 212 in FIG. 2 and/or the element 316 may be used to implement the element 216 in FIG. 2.

In the exemplary embodiment shown in FIG. 3A, each TX/RX chain 330 includes a switch/duplexer 332, a PA 334, an LNA 336, and a phase shifter 338, which are coupled as shown in FIG. 3A. TX/RX chain 331 includes a switch/duplexer 333, a PA 335, and an LNA 337, which are coupled as shown in FIG. 3A. A phase shifter may not be included in TX/RX chain 331, for example when separate antenna 314 comprises a single antenna element 316. TX/RX chain 330 and/or TX/RX chain 331 may include different and/or additional circuits not shown in FIG. 3A. In general, a TX/RX chain is a circuit block that includes (i) at least one circuit in the transmit direction and (ii) at least one circuit in the receive direction. The at least one circuit in the transmit direction may be part of a TX chain and may include a PA, a switch, a duplexer, a diplexer, a phase splitter, a signal splitter, etc. The at least one circuit in the receive direction may be part of an RX chain and may include an LNA, a switch, a duplexer, a diplexer, a phase splitter, a signal combiner, etc.

The transceiver 320 may further include an ADC 375. Switch 346 may couple TX/RX chain 331 to either ADC 375 or splitter/combiner 344. An input RF signal from LNA 337 may be routed through switch 346, and digitized by ADC 375.

In the exemplary embodiment shown in FIG. 3B, a portion of the transceiver includes a transmit portion 350, a receive portion 370, and a local oscillator (LO) 382 or synthesizer. In the exemplary embodiment shown in FIG. 3B, transmit portion 350 includes (i) a digital-to-analog converter (DAC) 352*a*, a lowpass filter 354*a*, a variable gain amplifier (VGA) 356*a*, and a mixer 358*a* for an inphase (I) transmit path and (ii) a DAC 352*b*, a lowpass filter 354*b*, a VGA 356*b*, and a mixer 358*b* for a quadrature (Q) transmit path. Transmit portion 350 further includes a summer 360 and a transmit driver (Drv) 362.

In the exemplary embodiment shown in FIG. 3B, receive portion 370 includes a receive driver 372. Receive portion 370 further includes (i) a mixer 374*a*, a VGA 376*a*, a lowpass filter 378*a*, and an analog-to-digital converter (ADC) 380*a* for an I receive path and (ii) a mixer 374*b*, a VGA 376*b*, a lowpass filter 378*b*, and an ADC 380*b* for a Q receive path.

In the exemplary embodiment shown in FIG. 3B, LO 382 includes a phase locked loop (PLL) 384, a voltage-controlled oscillator (VCO) 386, and a frequency multiplier (Freq Mult) 388. VCO 386 receives a control signal from PLL 384 and generates a VCO signal at a desired frequency determined by the control signal, which may be 15 GHz for IEEE 802.11ad or some other frequency. Frequency multiplier 388 multiplies the VCO signal in frequency (e.g., by a factor of 4) and provides an LO signal (e.g., at a frequency of 60 GHz for IEEE 802.11ad). PLL 384 receives a reference signal and the VCO signal from VCO 386, compares the phase of the VCO signal against the phase of the reference signal, and generates the control signal for VCO 386 such that the phase of the VCO signal is locked to the phase of the reference signal. LO 382 may also be implemented in other manners.

For data transmission, data processor 390 processes (e.g., encodes and modulates) data to be transmitted and may provide I and Q output samples to transmit portion 350. Within transmit portion 350, the I and Q output samples are converted to analog signals by DACs 352*a* and 352*b*, filtered by lowpass filters 354*a* and 354*b*, amplified by VGAs 356*a* and 356*b*, and upconverted by mixers 358*a* and 358*b*. The I and Q upconverted signals from mixers 358*a* and 358*b* are summed by summer 360 and amplified by transmit driver 362 to generate an output RF signal.

Referring to FIG. 3A, the output RF signal is split by splitters 344, 342 and 340 to obtain an output RF signal for each TX/RX chain 330. Within each TX/RX chain 330, the output RF signal is phase shifted by phase shifter 338 by an amount selected for an associated antenna element 312. The phase-shifted output RF signal is amplified by PA 334 to generate a transmit RF signal, which is routed through switch/duplexer 332 and transmitted via the associated antenna element 312. Different phase shifts may be applied for different antenna elements 312 to obtain a desired antenna beam.

For data reception, antenna elements 312 receive signals from base stations and/or other stations or devices, and each antenna element 312 provides a respective received RF signal to an associated TX/RX chain 330. Within each TX/RX chain 330, the received RF signal is routed through switch/duplexer 332, amplified by LNA 336, and phase shifted by phase shifter 338 by an amount selected for the associated antenna element 312. The phase-shifted received RF signals from all TX/RX chains 330 are combined by combiners 340, 342 and 344 to obtain an input RF signal, which is provided to receive portion 370. Referring to FIG. 3B, within receive portion 370, the input RF signal is amplified by receive driver 372, downconverted by mixers 374*a* and 374*b*, amplified by VGAs 376*a* and 376*b*, filtered by lowpass filters 378*a* and 378*b*, and digitized by ADCs 380*a* and 380*b* to obtain I and Q input samples, which are provided to data processor 390.

FIGS. 3A and 3B show an exemplary embodiment of transceiver 320, transmit portion 350, and receive portion 370. Transceiver 320 may include additional, fewer, or different circuits. For example, transceiver 320 may include switches, duplexers, diplexers, transmit filters, receive filters, matching circuits, an oscillator, etc. Transmit portion 350 and receive portion 370 may each include additional, fewer, or different circuits. The circuits in transmit portion 350 and/or receive portion 370 may also be arranged differently than the arrangement shown in FIGS. 3A and 3B. For example, DACs 352 and ADCs 380 may be part of transceiver 320 (as shown in FIG. 3B) or may be part of data processor 390. All or a portion of transceiver 320 may be implemented on one or more analog integrated circuits (ICs), RF ICs (RFICs), mixed-signal ICs, etc.

Referring to FIG. 3B, data processor 390 may perform various functions for wireless device 300. For example, data processor 390 may perform processing for data being transmitted via transceiver 320 and data being received via transceiver 320. Data processor 390 may also control the operation of various circuits within transceiver 320. Data processor 390 includes a memory 392 to store program code and data for data processor 390. The processor 390 may be implemented in any number of ways and may be implemented separate from or outside of the transceiver 320. Data processor 390 may be implemented on one or more application specific integrated circuits (ASICs) and/or other ICs and/or in a dedicated chip.

Wireless device 300 may utilize antenna array 310 for data transmission and/or data reception. Wireless device 300 may utilize separate antenna 314 for data transmission and/or data reception and also for discovery to detect other stations and to allow other stations to detect wireless device 300.

The 60 GHz frequency band is different from other frequency bands that are combined in a smartphone, such as 2.4 GHz (Wi-Fi), 1.5 GHz (GPS), 5 GHz (Wi-Fi), near field communication (NFC) and Cellular Bands, in that it is over a decade higher than the other frequency bands. The 60 GHz frequency band is an order of magnitude greater than the other example bands. This makes combining the antennas as multi-band antennas difficult for 60 GHz. Nevertheless, smart phones are limited in the space that is available and, therefore, reducing the area required to implement certain features may be beneficial. In certain embodiments herein, an antenna aperture is reused for multiple antenna elements, for example for a mm-wave antenna element and an element that is configured to transmit or receive at a frequency that is less than 10 GHz.

Due to the more than a decade difference in frequency between many legacy bands (e.g., bands mentioned above) and 60 GHz, it is possible to place an array of 60 GHz antennas on the metal of the legacy band antenna without impacting the legacy band antenna or the 60 GHz antennas to an amount that would substantively affect operation of the device, such as the device 100. The 60 GHz antenna may be connected to the ground of the chassis of the device. The legacy antenna may be coupled to a path to ground (DC ground) that the connection to the 60 GHz antenna can be positioned adjacent to (e.g. upon) which may reduce disturbance of the function of the legacy antenna. It is possible that the connection could be a coaxial cable, a two wire line, a flex or rigid PCB, or any combination thereof. The 60 GHz antenna can further be connected to one or more of a DC signal, a control signal, LO, and/or IF or RF signals, in any multiplicity of connections or combining of signals, e.g., by way of multiplexers or bias-T circuits. This connection may be positioned adjacent to (e.g., on) the ground connection of the legacy antenna, and the 60 GHz array can be positioned adjacent (e.g., on) the structure of the legacy antenna and the antennas of the 60 GHz array can share an aperture with the legacy antenna. Types of antennas that are DC grounded can include patches, dipole, IFA, PIFA, MIFA, slot, bowtie, horn and notches, which can all be modified to allow for 60 GHz operation and legacy band operation simultaneously.

Figure 4:
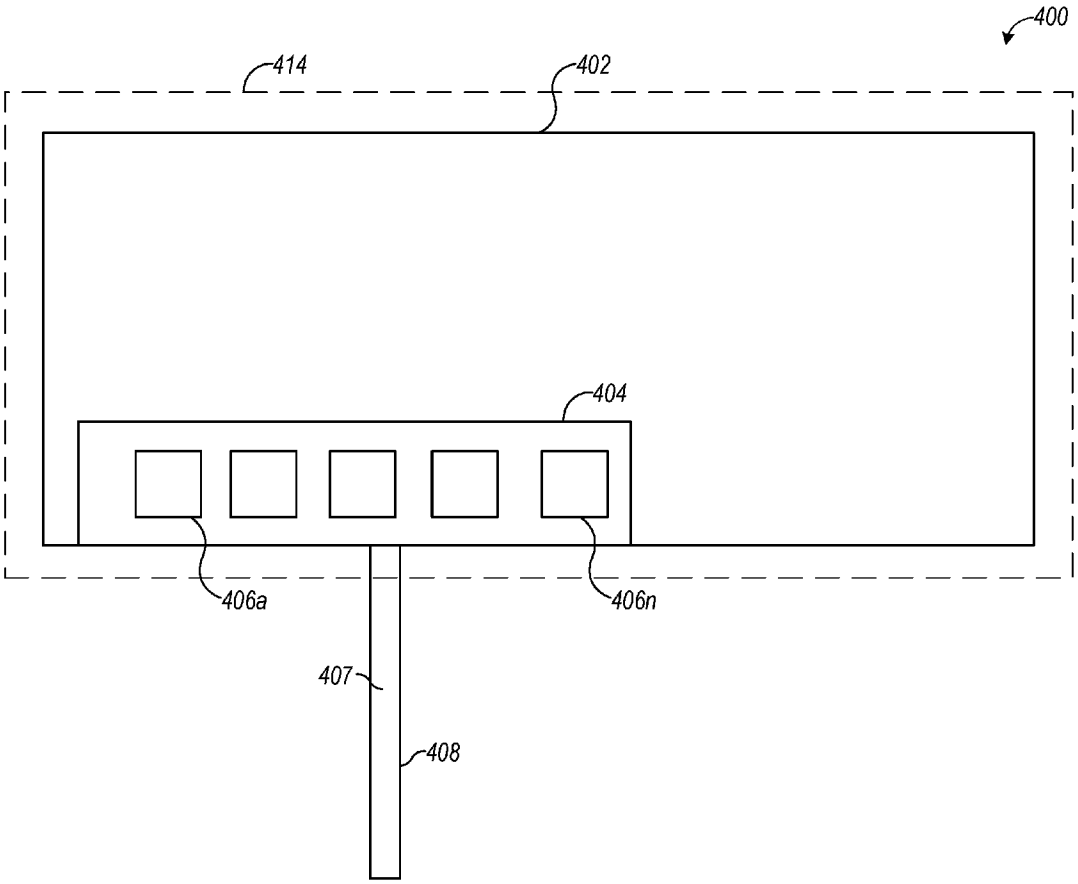
FIG. 4 illustrates an antenna of a wireless device, in accordance with an exemplary embodiment.

FIG. 4 illustrates an antenna of a wireless device 400, in accordance with an exemplary embodiment. Wireless device 400 may be one exemplary embodiment of wireless device 110, 200, and/or 300.

Wireless device 400 may be configured so as to provide an aperture 414 through which a plurality of antennas 402 and 404 may transmit and/or receive signals. The aperture may, for example, comprise a hole, gap, or opening of any number of shapes in a board and/or housing of the device 400. For example, the device 400 may be formed in such a way that signals transmitted and/or received by the antennas 402 and 404 do not pass through any tangible portion of the device 400 when propagating through the aperture 414. In some embodiments, the aperture 414 is formed such that a vector perpendicular to a plane of any of the antennas or elements 402-406 passes through the aperture.

Antenna 402 may operate in a first frequency band and array antenna 404 may operate in a second frequency band, wherein there is approximately a decade or more difference between the first frequency band and the second frequency band. More specifically, as an example, the second frequency band may be at least one decade higher than the first frequency band. According to yet a more specific example, antenna 402 may be configured for a 2.4 GHz (Wi-Fi), 1.5 GHz (GPS), 5 GHz (Wi-Fi), NFC or Cellular Band, and array antenna 404, which may include a plurality of antenna elements 406*a*-406*n*, may be configured for a 28 GHz or 60 GHz band.

In the embodiment illustrated in FIG. 4, antenna 402 may include an antenna that is DC grounded and array antenna 404 may include, for example only, patches, dipoles, IFA, PIFA, MIFA, slot, bowtie, horn and notches. Array antenna 404 may include a connection 408, which may also be referred to herein as an "electrical feed," that may be positioned adjacent a path to ground (DC ground) 407 for antenna 402.

Figure 5:
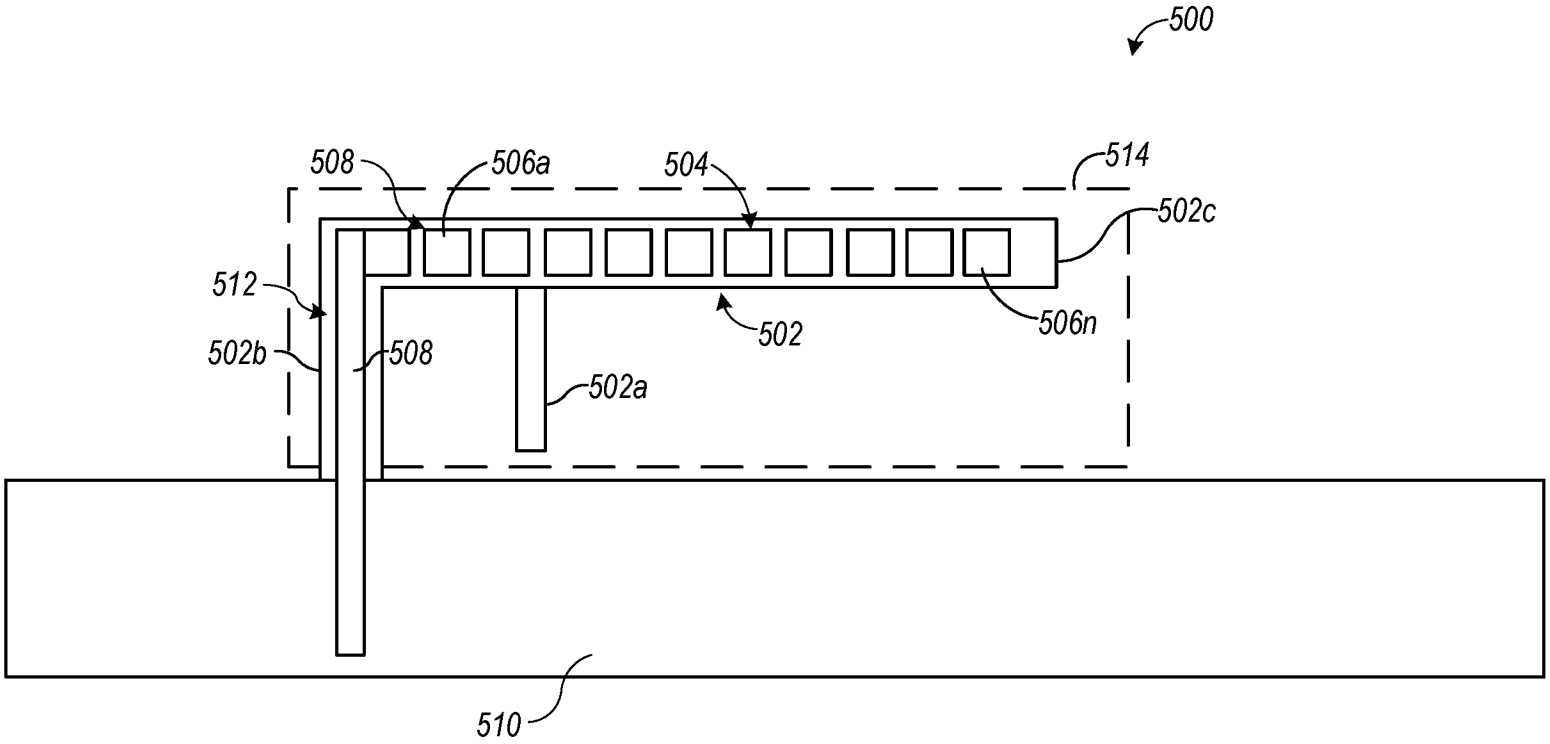
FIG. 5 illustrates an antenna of a wireless device, according to an exemplary embodiment.

FIG. 5 illustrates an antenna of a wireless device 500, according to an exemplary embodiment. Wireless device 500 may be one exemplary embodiment of wireless device 110, 200, and/or 300.

Wireless device 500 includes a planar inverted-F antenna (PIFA) 502 and an array antenna 504, which, in this example, comprises a 60 GHz printed array. Array antenna 504 may include a plurality of antenna elements 506*a*-506*n*, for example through which signals are transmitted and/or received. PIFA 502 may include a feed connection 502*a*, a ground connection 502*b* and a radiating element 502*c*. PIFA 502 couples to a ground plane (i.e., a DC ground) 510 through a ground path 512 (i.e., an electrical path to ground) along the ground connection 502*b*. The PIFA radiating element 502*c* may be located adjacent to a wireless device antenna aperture 514 allowing propagation and reception of electromagnetic waves therethrough. For example, the device 500 may be formed in such a way that signals transmitted and/or received by the antennas 502 and 504 do not pass through any tangible portion of the device 500 (other than portions of the antennas 502 and 504) when propagating through the aperture 514.

Wireless device 500 may include an array antenna connection 508, which may comprise, for example only, a printed circuit board (PCB), a cable, and/or a multiple wire line for delivering power and/or transmitting/receiving signals to/from array antenna 504. As a non-limiting example, the array antenna connection 508 may comprise a rigid or flex PCB. The array antenna connection 508 is positioned adjacent to (e.g., positioned on, positioned over, positioned in contact with) the ground path 512 along the ground connection 502*b* of PIFA 502. In the embodiment illustrated in FIG. 5, the array antenna 504 overlaps portions of the antenna 502 when viewed from a direction in which signals propagate through the aperture 514. Elements 506 of the array antenna 504 may be printed or deposited on the antenna 502 and/or may be separated from the antenna 502 by one or more layers of material.

Figure 6:
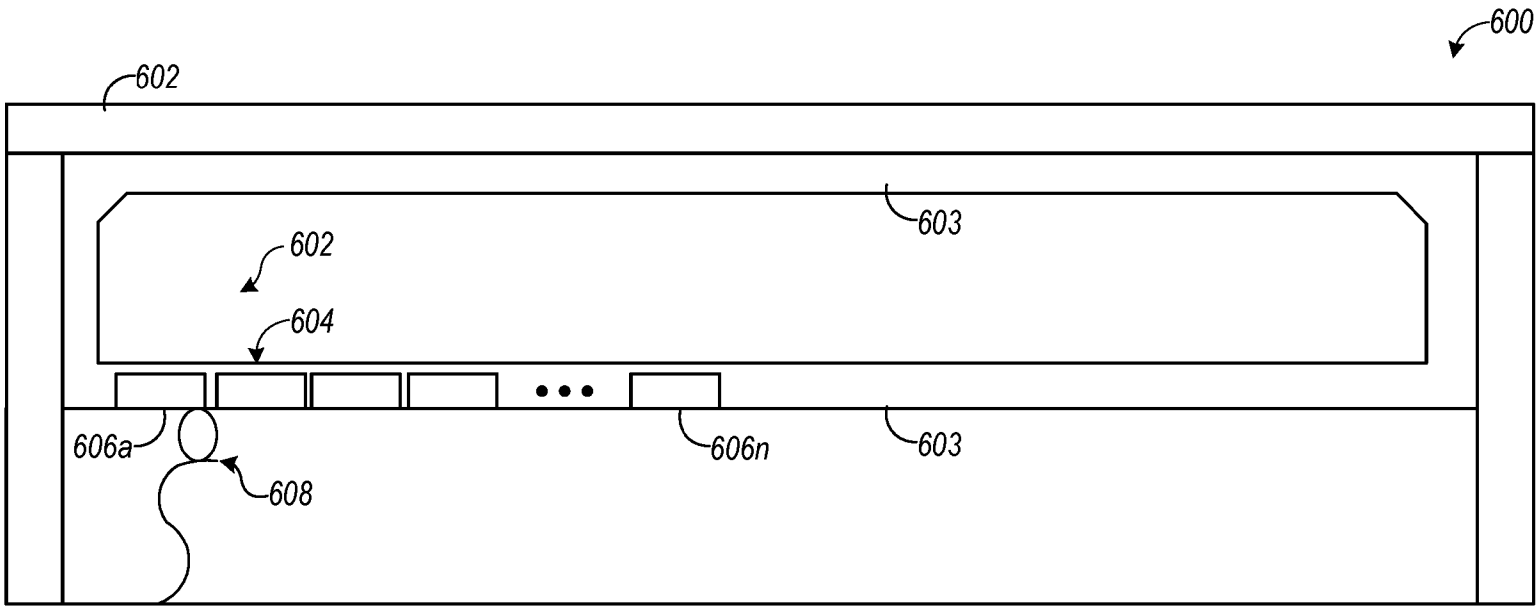
FIG. 6 is an illustration of an antenna of a wireless device, in accordance with another exemplary embodiment.

FIG. 6 is an illustration of an antenna of wireless device 600, in accordance with another exemplary embodiment. Wireless device 600 may be one exemplary embodiment of wireless device 110, 200, and/or 300.

Wireless device 600 includes a legacy band slot antenna 602 and an array antenna 604, which, in this example, comprises a 60 GHz slot array. Slot antenna 602 may include a dielectric 603, such as plastic. Array antenna 604 may include a plurality of antenna elements 606*a*-606*n*, for example through which signals are transmitted and/or received. Slot antenna 602 may include a ground (e.g., a DC ground) and a ground path (e.g., an electrical path to ground). Further, device 600 may include a connection 608, which may comprise, for example only, a printed circuit board (PCB), a cable, and/or a multiple wire line for delivering power and/or transmitting/receiving signals to/from array antenna 604. As a more specific, non-limiting example, connection 608 may comprise coaxial cable, which is positioned adjacent to (e.g., positioned on, positioned over, positioned in contact with) a ground path for slot antenna 602. In some embodiments, the antenna 602 and array antenna 604 may separately and/or simultaneously transmit and/or receive signals through a shared or common aperture.

Figure 7:
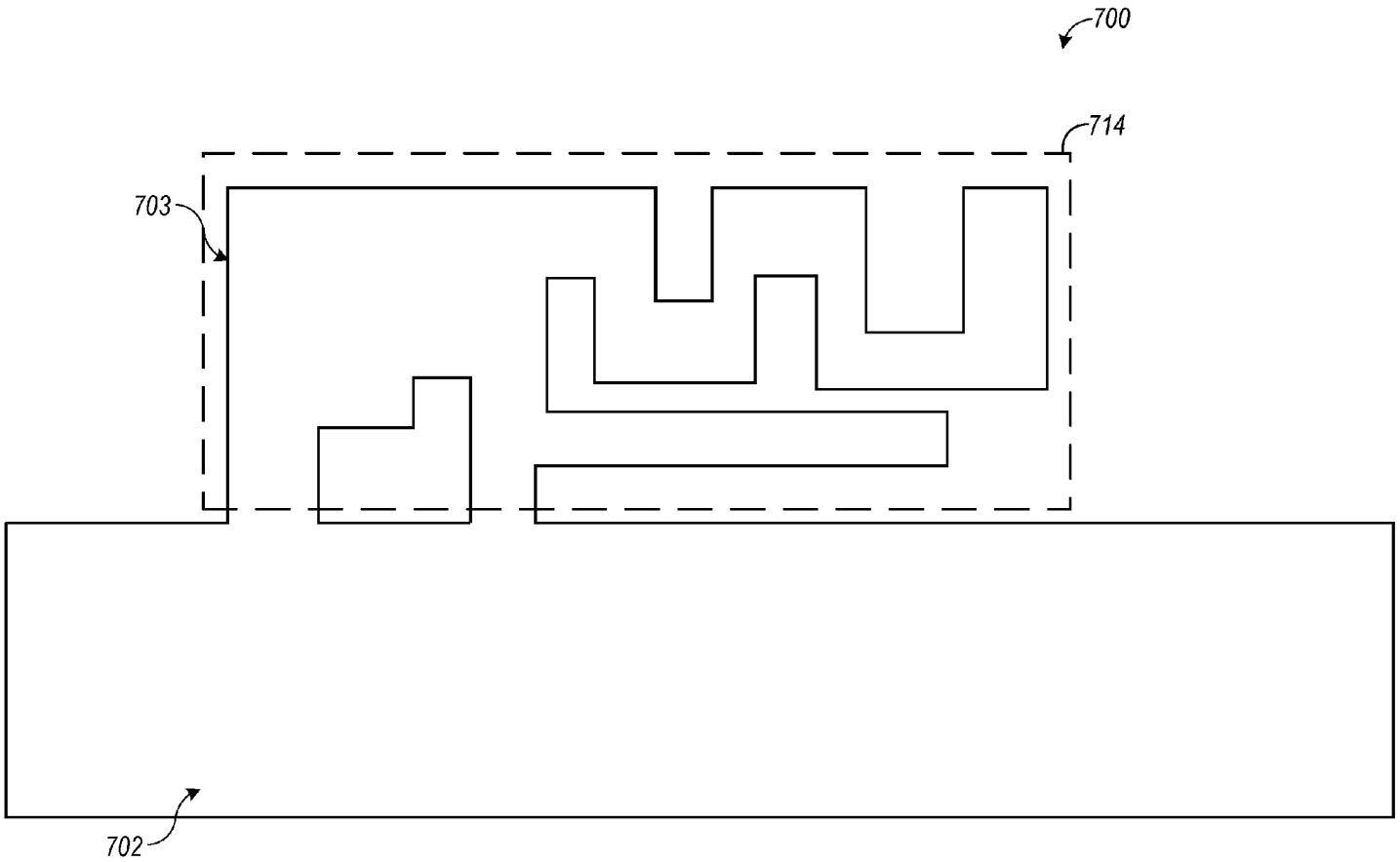
FIG. 7 depicts a meandered inverted-F antenna (MIFA) of a wireless device.

FIG. 7 depicts a meandered inverted-F antenna (MIFA) 700 of a wireless device. The wireless device may be one exemplary embodiment of wireless device 110, 200, and/or 300.

The MIFA 700, includes a MIFA ground element 702 and a MIFA meander element 703. The MIFA meander element 703 may be located adjacent to an aperture 714 in the wireless device, allowing propagation and reception of electromagnetic waves therethrough.

Figure 8:
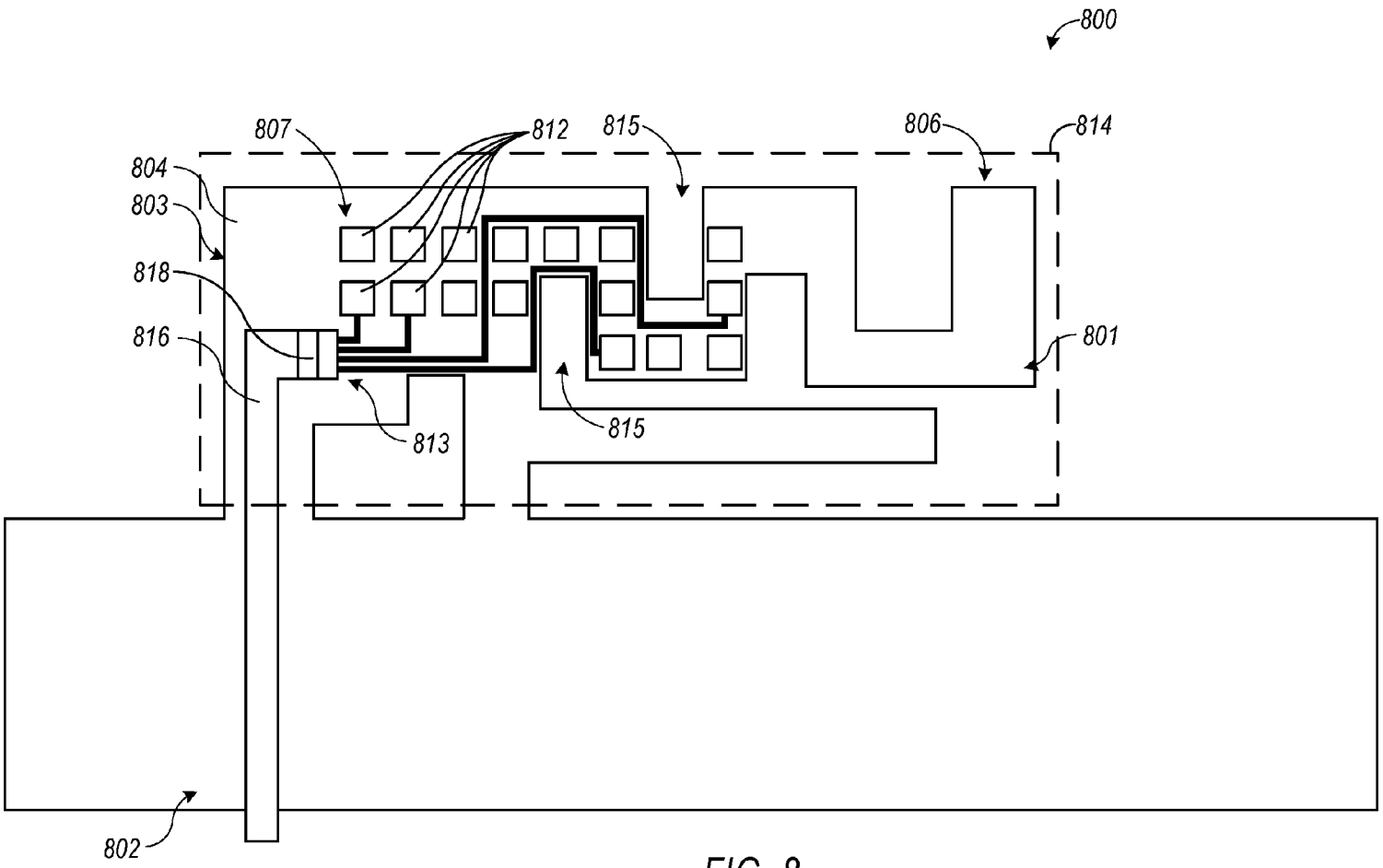
FIG. 8 illustrates an antenna of a wireless device, according to another exemplary embodiment.

FIG. 8 illustrates an antenna of a wireless device 800, according to another exemplary embodiment. Wireless device 800 may be one exemplary embodiment of wireless device 110, 200, and/or 300.

Wireless device 800 includes a legacy band MIFA 801 (which may be implemented similar to the MIFA 700) and an array antenna 807, which may be a millimeter (mm) wave antenna such as a 60 GHz array antenna. MIFA 801 includes various portions including a MIFA ground element 802, and a MIFA meander element 803 beginning near base 804 and extending to a MIFA meander element tip 806. The MIFA meander element 803 may be located adjacent to a wireless device antenna aperture 814 allowing propagation and reception of electromagnetic waves therethrough. For example, the device 800 may be formed in such a way that signals transmitted and/or received by the antennas 801 and 807 do not pass through any tangible portion of the device 800 (other than portions of the antennas 801 and 807) when propagating through the aperture 814.

Array antenna 807 is configured to overlay or piggyback on at least a portion of MIFA 801. For example, array antenna 807 may be formed on additional dielectric and conductive layers of a substrate used to form the underlying MIFA 801. By way of example, MIFA 801 may be formed on a multilayer circuit board where one or more layers are available for forming one or more antenna array elements 812, for example through which signals are transmitted and/or received. Antenna array elements 812 may couple to a transceiver 220 (FIG. 2) through respective array conductors 813 which may be further routed through an array conductor interconnection 816. Further, array conductors 813 may couple via a connector 818 to array conductor interconnection 816, such as a flexible printed wiring arrangement.

Furthermore, placement of both antenna array elements 812 and routing of antenna array elements 812 along the MIFA antenna elements, such as over the MIFA ground element 802 and along the contours of the MIFA meander element 803, may result in reduced impact to the performance of MIFA 801. Placement of antenna array elements 812 or array conductors 813 in or adjacent voids or keep-outs 815, in contrast, may result in deleterious effects to the performance of MIFA 801. In FIG. 8, for clarity, only an illustrative portion of array conductors 813 are illustrated as connecting to a respective portion of antenna array elements 812. For completeness, each antenna array element 812 may couple via a respective array conductor 813 to transceiver 220 (FIG. 2). Also for clarity in FIG. 8, only a subset of antenna array elements 812 are individually identified but all similarly illustrated elements are also antenna array elements 812.

Figure 9:
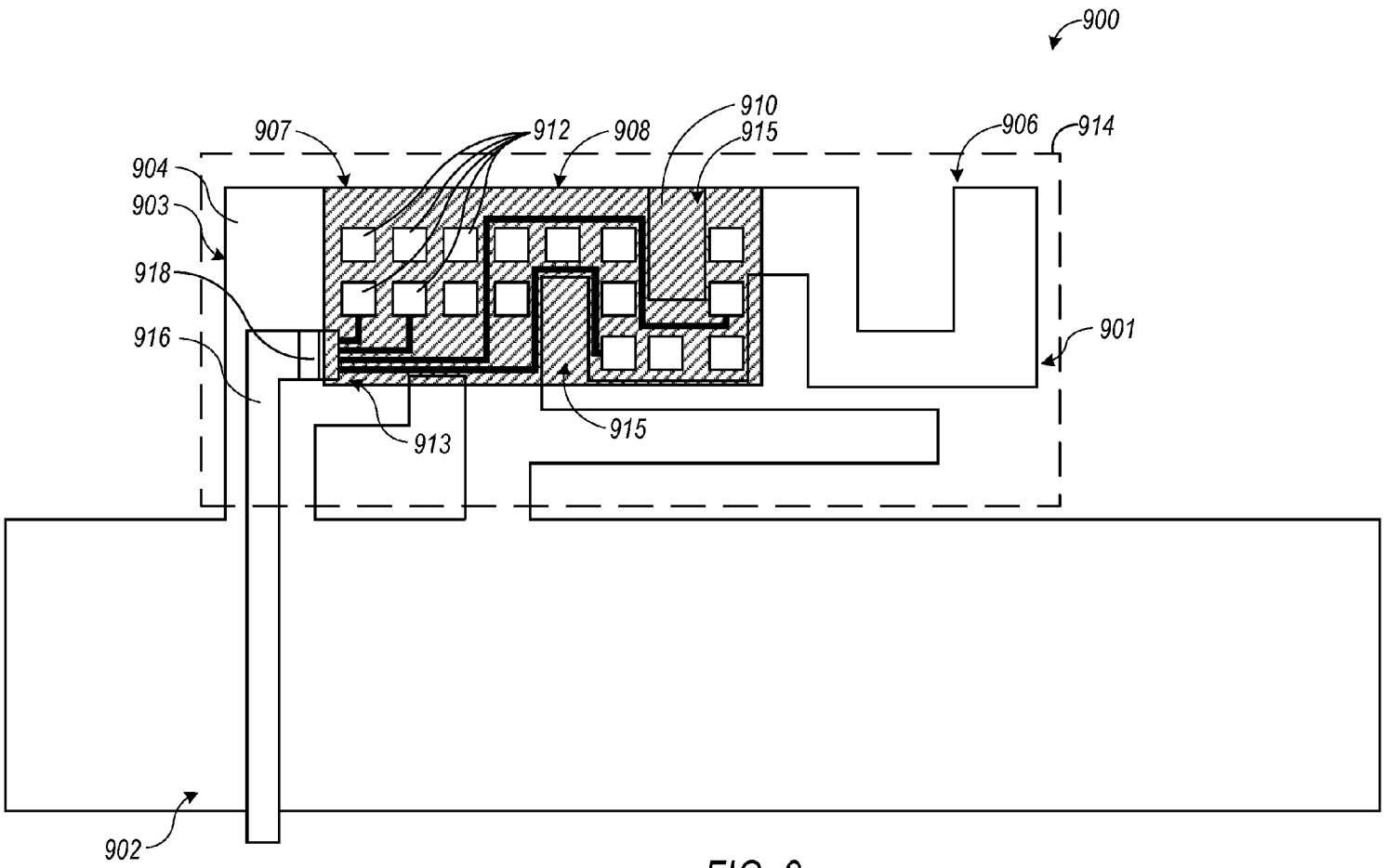
FIG. 9 illustrates an antenna of a wireless device, according to another exemplary embodiment.

FIG. 9 illustrates an antenna of a wireless device 900, according to another exemplary embodiment. Wireless device 900 may be one exemplary embodiment of wireless device 110, 200, and/or 300.

Wireless device 900 includes a legacy band MIFA 901 and an array antenna 907, which may be a millimeter (mm) wave antenna such as a 60 GHz array. MIFA 901 includes various portions including a MIFA ground element 902, and a MIFA meander element 903 beginning near base 904 and extending to a MIFA meander element tip 906. Some of the contours of the meander element 903 are obscured in FIG. 9 by array antenna 907. The MIFA meander element 903 may be located adjacent to a wireless device antenna aperture 914 allowing propagation and reception of electromagnetic waves therethrough. For example, the device 900 may be formed in such a way that signals transmitted and/or received by the antennas 901 and 907 do not pass through any tangible portion of the device 800 (other than portions of the antennas 901 and 907) when propagating through the aperture 914.

Array antenna 907 includes an array element module 908 configured as an assembly to overlay or piggyback on at least a portion of MIFA 901. In FIG. 9, array element module 908 overlays a portion of the MIFA meander element 903. While FIG. 9 illustrates array element module 908 only partially overlaying MIFA meander element 903, array element module 908 may be extended to completely overlay MIFA meander element 903 or even extend beyond MIFA meander element tip 906 of MIFA meander element 903. Further, module 908 is illustrated as extending over voids 915, but the module 908 may be formed so as not to cover the voids 915.

Array element module 908 may be configured as a printed circuit board, for example as a module substrate 910, including one or more dielectric and conductive layers. Array element module 908 may include one or more antenna array elements 912, for example through which signals are transmitted and/or received. Array elements 912 may couple to a transceiver 220 (FIG. 2) through respective array conductors 913 which may be further routed through an array conductor interconnection 916. Further, array conductors 913 may couple via a connector 918 to array conductor interconnection 916, such as a flexible printed wiring arrangement.

As described above with respect to FIG. 8, placement of both antenna array elements 912 and routing of antenna array elements 912 on module substrate 910 over the MIFA antenna elements—e.g., so the array antenna 907 overlaps portions of the antenna 901 when viewed from a direction in which signals propagate through the aperture 914—such as over the MIFA ground element 902 and along the contours of the MIFA meander element 903, may result in reduced impact to the performance of MIFA 901. Placement of antenna array elements 912 or array conductors 913 over array conductor voids or keep-outs 915 may result in deleterious effects to the performance of MIFA 901. In FIG. 9, for clarity, only an illustrative portion of array conductors 913 are illustrated as connecting to a respective portion of antenna array elements 912. For completeness, each antenna array element 912 may couple via a respective array conductor 913 to transceiver 102. Also for clarity in FIG. 9, only a subset of antenna array elements 912 are individually identified but all similarly illustrated elements are also antenna array elements 912.

Figure 10:
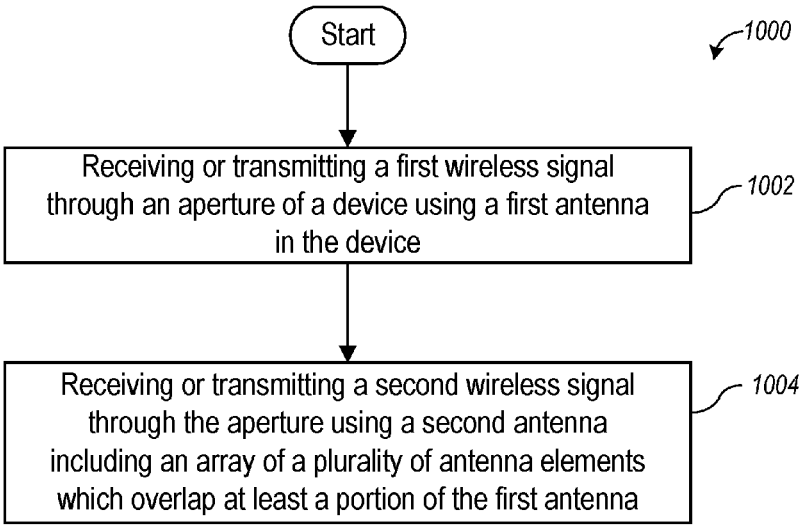
FIG. 10 is a flowchart illustrating a method, in accordance with one or more exemplary embodiments.

FIG. 10 is a flowchart illustrating a method 1000, in accordance with one or more exemplary embodiments. Method 1000 may include receiving or transmitting a first wireless signal through an aperture (e.g., aperture 414, 514, 814, and/or 914) of a device using a first antenna (e.g., antenna 402, 502, 602, 801, or 901) in the device (depicted by numeral 1002). Method 1000 may also include receiving or transmitting a second wireless signal through the aperture using a second antenna (e.g., array antenna 404, 504, 604, 807, or 907) including an array of a plurality of antenna elements which overlap at least a portion of the first antenna (depicted by numeral 1004).

Figure 11:
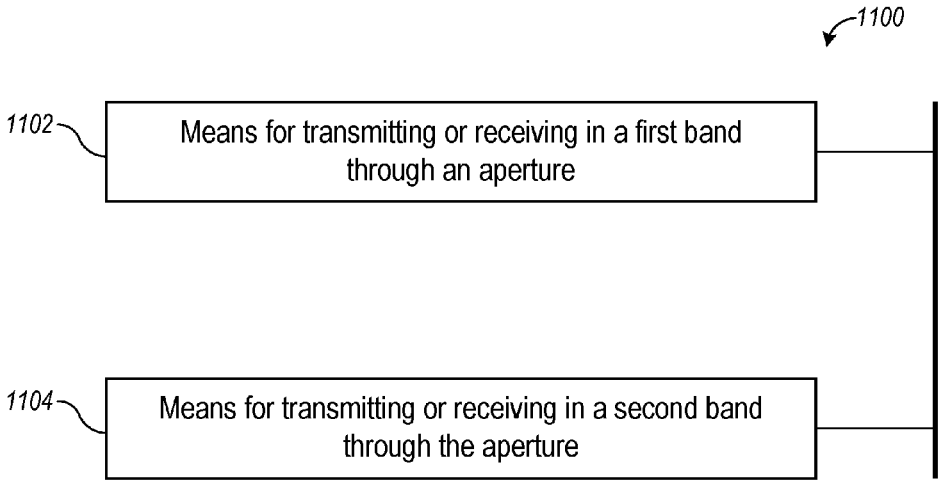
FIG. 11 illustrates an antenna of a wireless device, according to other exemplary embodiments.

FIG. 11 illustrates an antenna 1100 of a wireless device, according to other exemplary embodiments. For example, device 1100 is suitable for use as any of devices, 110, 200, 300, 400, 500, 600, 800 and/or 900, as shown in FIGS. 1-6, 8 and 9. In one aspect, device 1100 is implemented by one or more modules configured to provide the functions as described herein. For example, in an aspect, each module comprises hardware and/or hardware executing software.

Device 1100 comprises a first module comprising means 1102 for transmitting or receiving in a first band through an aperture. For example, a signal in the first band may be received and/or transmitted via antenna 214, 314, 402, 502, 602, 801 and/or 901 (see FIGS. 2-6, 8 and 9).

Device 1100 also comprises a second module comprising means 1104 for transmitting or receiving in a second band through the aperture. The means 1104 may be included in an array of a plurality of the means 1104. For example, a signal in the second band may be received and/or transmitted via array antenna 210, 310, 404, 504, 604, 807 and/or 907 (see FIGS. 2-6, 8 and 9). The means 1104 may overlap at least a portion of the means 1102.

Exemplary embodiments as described herein may allow for efficient use of space when packaging antennas for platforms making devices more desirable for manufacturing purposes and, therefore, more likely to be integrated into future platforms. Various embodiments may provide for area reduction of an antenna system and simplified integration of a plurality of antennas with a shared antenna aperture.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the exemplary embodiments shown herein but is to be accorded the widest scope consistent with the principles and novel features disclosed herein.

What is claimed is:

1. A device comprising:

a first antenna configured to transmit or receive through an aperture provided by the device; and a second antenna including an array of a plurality of antenna elements configured to transmit or receive through the aperture, the plurality of antenna elements overlapping at least a portion of the first antenna;

wherein the first antenna is configured as a meandering inverted-F antenna (MIFA) having a meander element, and the plurality of antenna elements overlap the meander element; and wherein the second antenna further comprises an array of conductors each coupled to a respective antenna element of the plurality of antenna elements, wherein the array of conductors are disposed along the meander element and coupled to the plurality of antenna elements to convey signals for transmission or signals received by the plurality of antenna elements from or to, respectively, a transceiver.

2. The device of claim 1, wherein the first antenna is configured to transmit or receive in a first band below 10 GHz and wherein the second antenna is configured to transmit or receive in a second band above 20 GHz.

3. The device of claim 2, wherein the first band is approximately 2.4 GHz, 1.5 GHz, or 5 GHz.

4. The device of claim 2, wherein the second band is approximately 28 GHz or 60 GHz.

5. The device of claim 1, wherein the first antenna and the plurality of antenna elements are disposed on conductive layers of a common substrate.

6. The device of claim 1, wherein the second antenna comprises a printed circuit board overlaying the first antenna.

7. The device of claim 1, wherein the plurality of antenna elements comprise an array printed onto the first antenna.

8. The device of claim 1, wherein the first antenna includes a ground connection path and wherein the second antenna comprises a plurality of conductors overlapping the ground connection path.

9. The apparatus of claim 1, wherein the first means includes a meander element, and the plurality of second means overlap the meander element.

10. The apparatus of claim 9, further comprising a plurality of means for conducting, each of the means for conducting coupled to a respective second means and disposed along the meander element.

11. The device of claim 1, wherein an entirety of each of the array conductors overlaps the meander element.

12. An apparatus comprising:

first means for transmitting or receiving in a first band through an aperture provided by the apparatus, the first means for transmitting comprising a meandering inverted-F antenna (MIFA) having a meander element;

an array of a plurality of second means for transmitting or receiving in a second band through the aperture, the second means overlapping at least a portion of the first means; and means for coupling the second means to a transceiver, the means for coupling the second means to the transceiver comprising an array of conductors disposed along and overlapping the meander element.

13. The apparatus of claim 12, wherein the first means is configured to transmit or receive in a first band below 10 GHz and wherein each of the second means is configured to transmit or receive in a second band above 20 GHz.

14. The apparatus of claim 12, wherein the first means and the second means are disposed on conductive layers of a common substrate.

15. The apparatus of claim 12, further comprising means for coupling the first means to a ground plane, wherein the means for coupling the second means to the transceiver overlapping the means for coupling the first means to the ground plane.

16. A method comprising:

receiving or transmitting a first wireless signal through an aperture of a device using a first antenna in the device, the first antenna comprising a meandering inverted-F antenna (MIFA) having a meander element;

receiving or transmitting a second wireless signal through the aperture using a second antenna including an array of a plurality of antenna elements which overlap at least a portion of the first antenna; and conveying a third signal, corresponding to the second wireless signal, to or from the second antenna from or to, respectively, a transceiver by an array of conductors disposed along and overlapping the meander element.

17. The method of claim 16, wherein the receiving or transmitting using the second antenna comprises receiving or transmitting the second wireless signal at approximately 28 GHz or 60 GHz using two or more antenna elements of the plurality of antenna elements.

18. The method of claim 17, wherein the receiving or transmitting using the first antenna comprises receiving or transmitting the first wireless signal at approximately 2.4 GHz, 1.5 GHz, or 5 GHz.

* * * * *